US011325388B2

(12) United States Patent
Tatsuta et al.

(10) Patent No.: US 11,325,388 B2
(45) Date of Patent: May 10, 2022

(54) LIQUID EJECTING APPARATUS AND LIQUID EJECTING UNIT

(71) Applicant: SEIKO EPSON CORPORATION, Tokyo (JP)

(72) Inventors: Daiki Tatsuta, Matsumoto (JP); Osamu Murayama, Yamagata-mura (JP); Yoji Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/820,768

(22) Filed: Mar. 17, 2020

(65) Prior Publication Data

US 2020/0298580 A1 Sep. 24, 2020

(30) Foreign Application Priority Data

Mar. 20, 2019 (JP) ..... JP2019-052353

(51) Int. Cl.
*B41J 2/14* (2006.01)
*B41J 2/175* (2006.01)
*B41J 2/16* (2006.01)

(52) U.S. Cl.
CPC ..... *B41J 2/17559* (2013.01); *B41J 2/1433* (2013.01); *B41J 2/162* (2013.01); *B41J 2002/14491* (2013.01)

(58) Field of Classification Search
CPC ..... B41J 2/17559; B41J 2/1433; B41J 2/162; B41J 2/14; B41J 2/145
See application file for complete search history.

(56) References Cited

U.S. PATENT DOCUMENTS

2007/0159204 A1* 7/2007 Hara ..... H05K 7/142 257/773
2007/0242102 A1 10/2007 Hirosawa et al.
2012/0038709 A1* 2/2012 Owaki ..... B41J 2/17513 347/40
2012/0162322 A1 6/2012 Tsuchiya et al.
2012/0182348 A1 7/2012 Ishii et al.
2015/0116424 A1* 4/2015 Nagata ..... B41J 25/3084 347/37

FOREIGN PATENT DOCUMENTS

JP H06-89760 A 3/1997
JP 2004-090494 A 3/2004
JP 2006-056244 A 3/2006
JP 2012-131152 A 7/2012
JP 2012-158169 A 8/2012

* cited by examiner

*Primary Examiner* — Jason S Uhlenhake
(74) *Attorney, Agent, or Firm* — Workman Nydegger

(57) ABSTRACT

A liquid ejecting unit includes: a liquid ejecting head configured to eject a liquid; a holding portion holding the liquid ejecting head; a coupling member; and a first fixing member fixing the liquid ejecting head to the holding portion, in which the coupling member is provided with a first coupling portion and a first through-hole, the liquid ejecting head is provided with a second coupling portion that is configured to be coupled to the first coupling portion, and the first fixing member passes through the first through-hole in a state in which the first coupling portion and the second coupling portion are coupled to each other.

19 Claims, 11 Drawing Sheets

<U3>

LIQUID EJECTING APPARATUS AND LIQUID EJECTING UNIT

The present application is based on, and claims priority from JP Application Serial Number 2019-052353, filed Mar. 20, 2019, the disclosure of which is hereby incorporated by reference herein in its entirety.

BACKGROUND

1. Technical Field

The present disclosure relates to a liquid ejecting apparatus and a liquid ejecting unit.

2. Related Art

A liquid ejecting apparatus that ejects a liquid such as an ink from a nozzle has been proposed in the related art. For example, JP-A-2006-056244 discloses an ink jet recording apparatus in which a recording head that ejects a liquid and a flexible wiring member electrically coupled to the recording head are mounted on a carriage. The carriage is fixed to the recording head by a positioning unit, and the flexible wiring member is fixed to the recording head by an adhesive or a sealant. That is, the flexible wiring member is individually fixed to the recording head.

However, when a member coupled to the recording head, such as the carriage and the flexible wiring member, is individually fixed to the recording head, there is a problem that a process of manufacturing the liquid ejecting apparatus is complicated.

SUMMARY

To solve the above-described problems, a liquid ejecting unit according to an exemplary aspect of the present disclosure includes: a liquid ejecting head that ejects a liquid; a holding portion that holds the liquid ejecting head; a coupling member; and a first fixing member that fixes the liquid ejecting head to the holding portion, in which the coupling member is provided with a first coupling portion and a first through-hole, the liquid ejecting head is provided with a second coupling portion that is configured to be coupled to the first coupling portion, and the first fixing member passes through the first through-hole in a state in which the first coupling portion and the second coupling portion are coupled to each other.

A liquid ejecting apparatus according to an exemplary aspect of the present disclosure includes: a liquid ejecting head that ejects a liquid; a controller that controls the liquid ejecting head; a holding portion that holds the liquid ejecting head; a coupling member; and a first fixing member that fixes the liquid ejecting head to the holding portion, in which the coupling member is provided with a first coupling portion and a first through-hole, the liquid ejecting head is provided with a second coupling portion that is configured to be coupled to the first coupling portion, and the first fixing member passes through the first through-hole in a state in which the first coupling portion and the second coupling portion are coupled to each other.

DESCRIPTION OF EXEMPLARY EMBODIMENTS

A. First Embodiment

Figure 1:
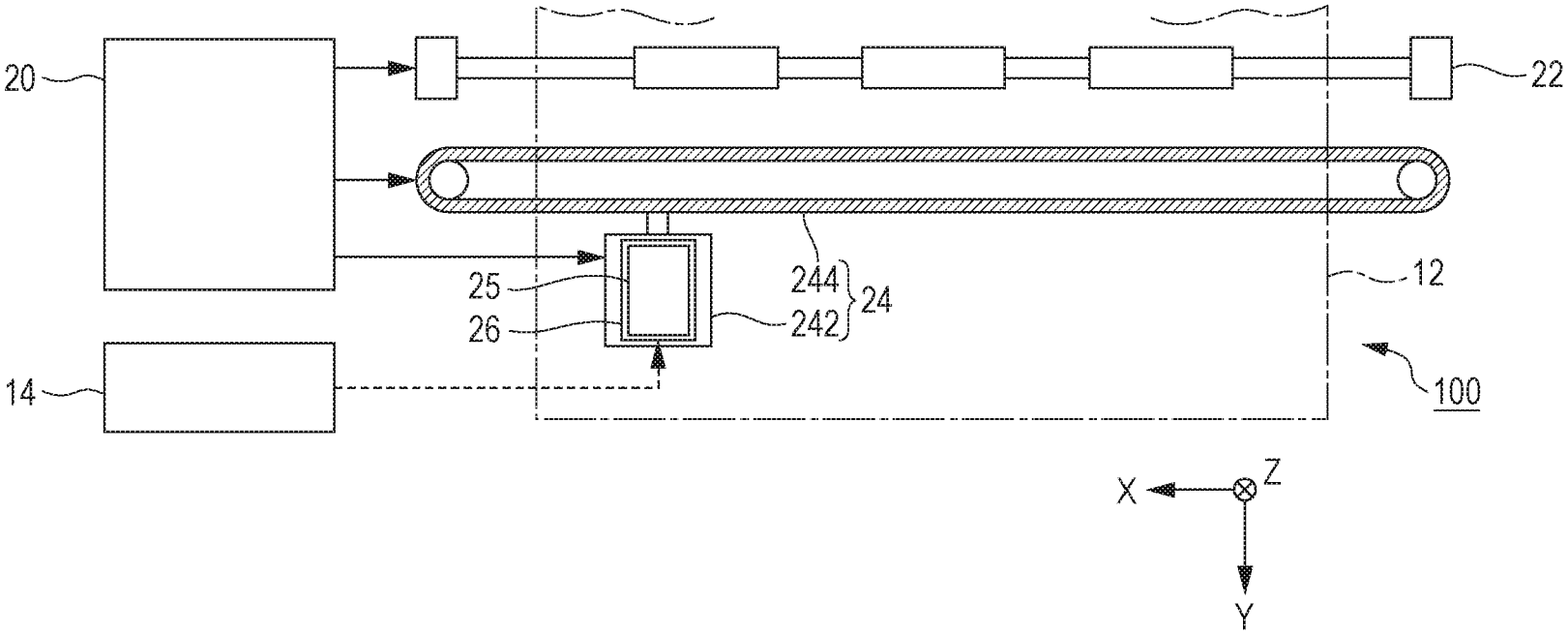
FIG. 1 is a configuration diagram of a liquid ejecting apparatus according to a first embodiment.

FIG. 1 is a diagram illustrating a liquid ejecting apparatus 100 according to a first embodiment. The liquid ejecting apparatus 100 according to the first embodiment is an ink jet recording apparatus that ejects ink, which is an example of a liquid, onto a medium 12. Although the medium 12 is typically a recording paper sheet, a recording target made of a predetermined material such as a resin film and a fabric is used as the medium 12. As illustrated in FIG. 1, the liquid ejecting apparatus 100 is provided with a liquid container 14 that stores the ink. For example, a cartridge which can be attached to and detached from the liquid ejecting apparatus 100, a bag-like ink pack formed of a flexible film, or an ink tank which can be replenished with the ink is used as the liquid container 14.

As illustrated in FIG. 1, the liquid ejecting apparatus 100 includes a control unit 20, a transport mechanism 22, a movement mechanism 24, a flow channel member 25, and a liquid ejecting head 26. The control unit 20 includes a processing circuit such as a central processing unit (CPU) and a field programmable gate array (FPGA) and a storage circuit such as a semiconductor memory, and integrally controls each component of the liquid ejecting apparatus 100. The control unit 20 is an example of a controller. The transport mechanism 22 transports the medium 12 along a Y axis under a control of the control unit 20.

The movement mechanism 24 causes the flow channel member 25 and the liquid ejecting head 26 to reciprocate along the X axis under the control of the control unit 20. The X axis intersects the Y axis along which the medium 12 is transported. For example, the X axis and the Y axis are perpendicular to each other. The movement mechanism 24 according to the first embodiment includes a substantially box-shaped carriage 242 that stores the flow channel member 25 and the liquid ejecting head 26 and a transport belt 244 to which the carriage 242 is fixed. A configuration in which a plurality of the liquid ejecting heads 26 and the flow channel member 25 are mounted on the carriage 242 or a configuration in which the liquid container 14 is mounted on the carriage 242 together with the liquid ejecting head 26 and the flow channel member 25 may be employed.

The flow channel member 25 is a structure for supplying the ink from the liquid container 14 to the liquid ejecting head 26. The liquid ejecting head 26 ejects the ink supplied from the flow channel member 25. In detail, the liquid ejecting head 26 ejects the ink supplied from the liquid container 14 to the medium 12 from a plurality of nozzles under the control of the control unit 20. Each liquid ejecting head 26 ejects the ink to the medium 12 together with the transportation of the medium 12 by the transport mechanism 22 and the repeated reciprocation of the carriage 242, so that a desired image is formed on the surface of the medium 12. In the following description, an axis that is perpendicular to the X-Y plane is thereinafter referred to as a Z axis. The Z axis is typically a vertical line.

Figure 2:
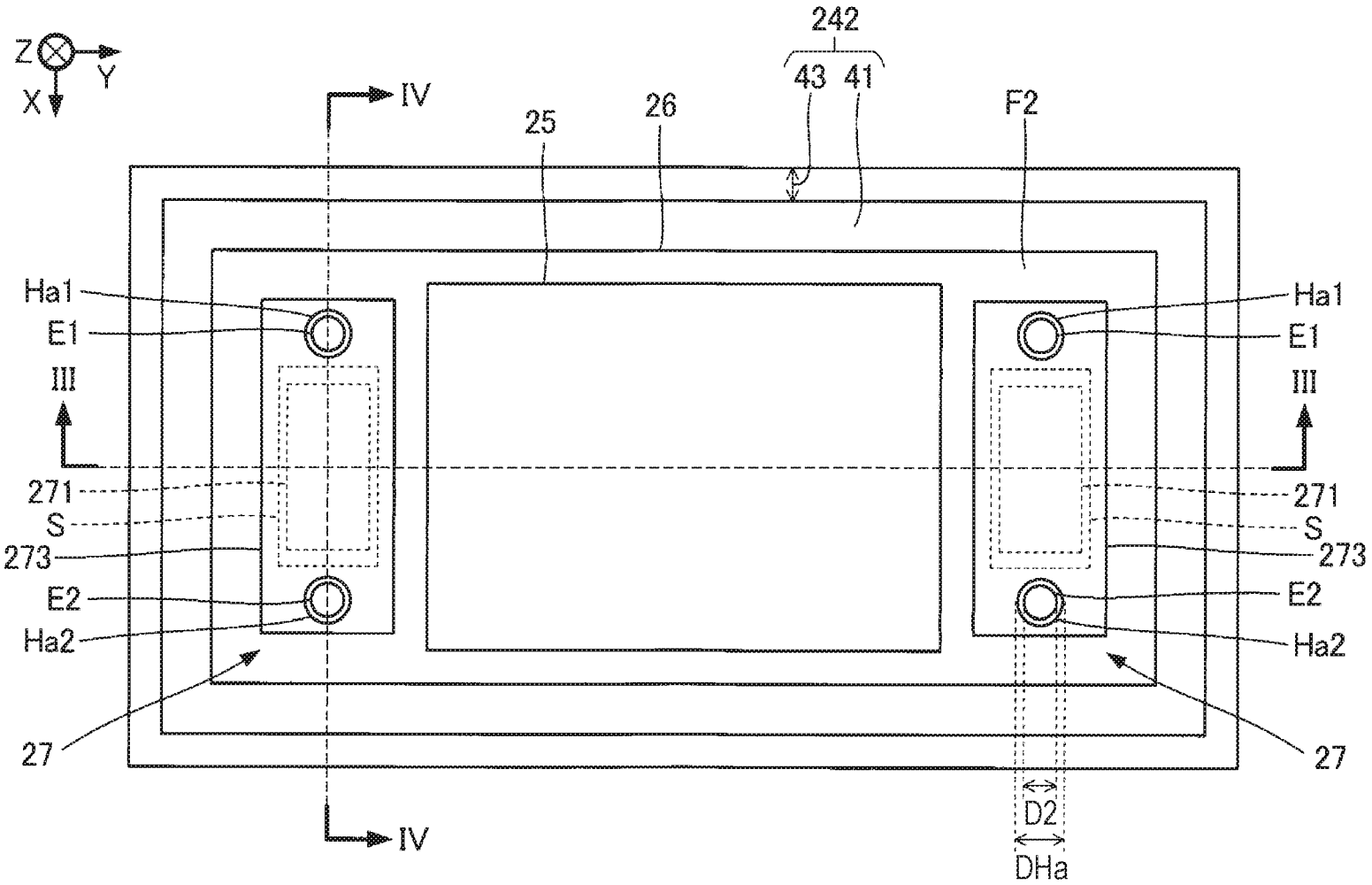
FIG. 2 is an enlarged plan view of the vicinity of a liquid ejecting head in FIG. 1.
Figure 3:
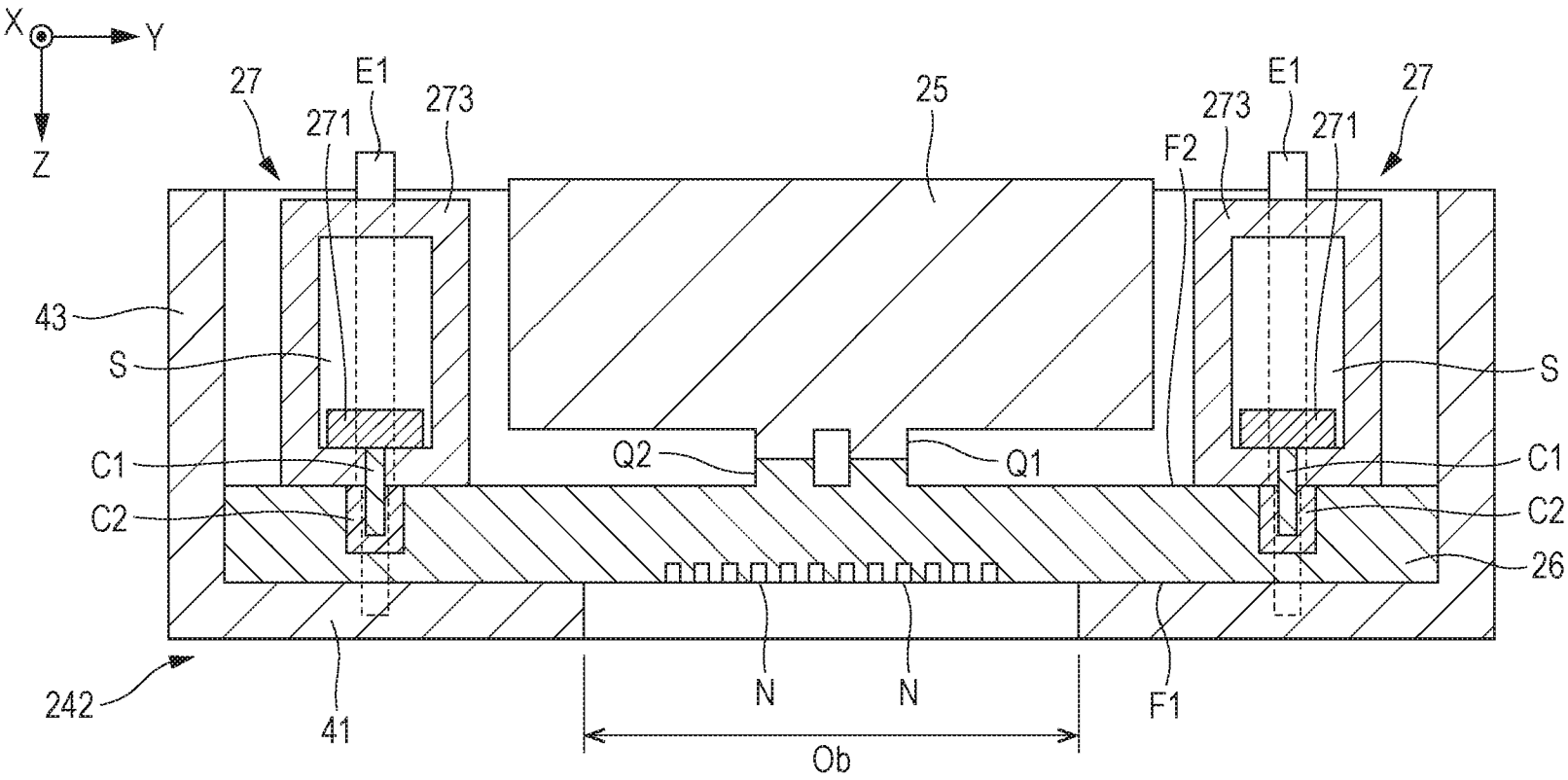
FIG. 3 is a sectional view taken along line III-III in FIG. 2.
Figure 4:
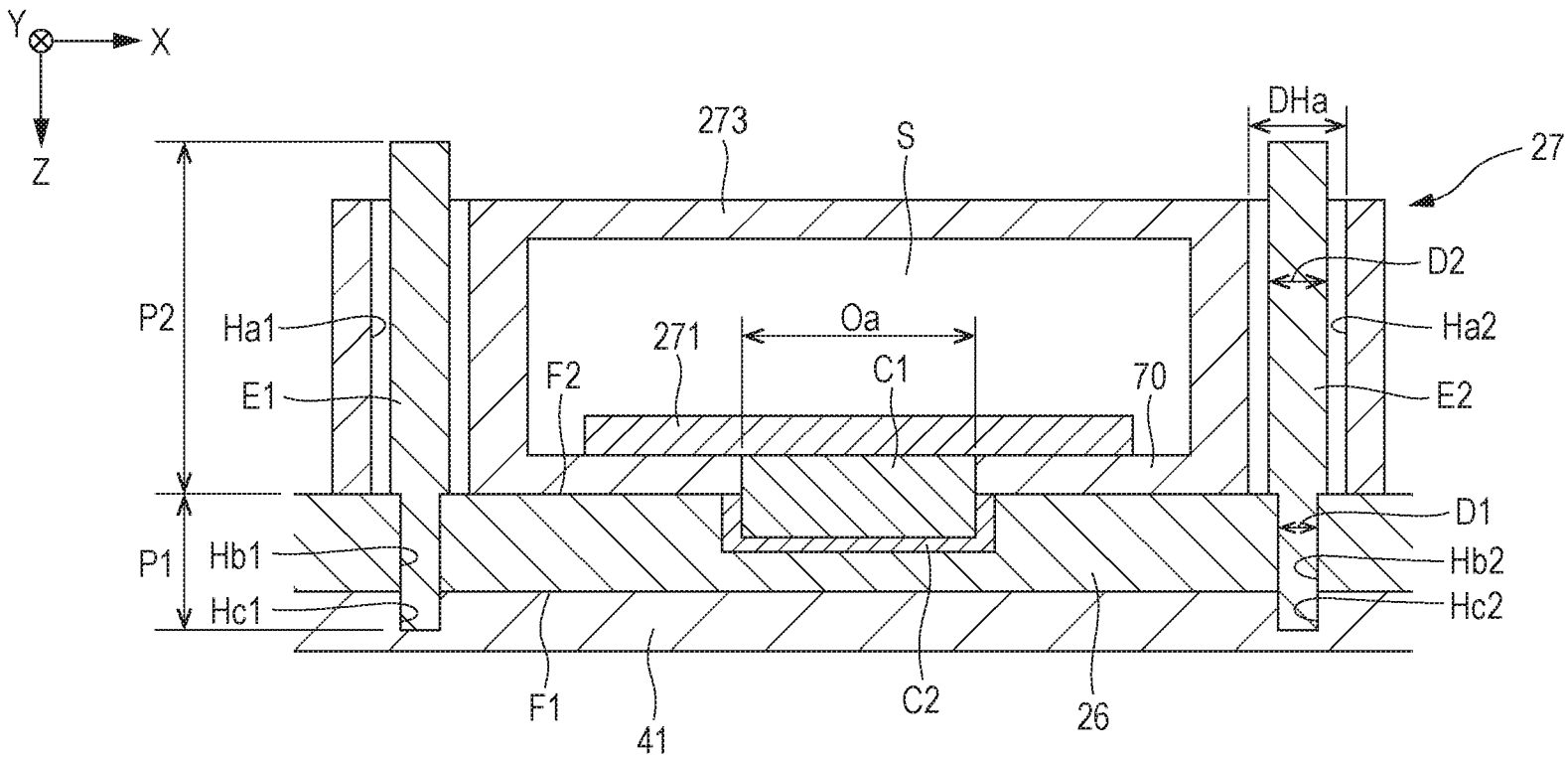
FIG. 4 is a sectional view taken along line IV-IV in FIG. 2.

FIG. 2 is an enlarged plan view of the vicinity of a liquid ejecting head 26 in FIG. 1. FIG. 3 is a sectional view taken along line III-III in FIG. 2, and FIG. 4 is a sectional view taken along line IV-IV in FIG. 2. The liquid ejecting head 26 includes a first surface F1 on which a nozzle is formed and a second surface F2 that is opposite to the first surface F1. A coupling member 27 and a flow channel member 25 are installed on the second surface F2. In the first embodiment, the coupling members 27 are installed on a positive side and a negative side of the Y axis on the second surface F2, respectively, and the flow channel member 25 is installed between the two coupling members 27. As illustrated in FIG. 3, a discharge flow channel Q1 of the flow channel member 25 and a supply flow channel Q2 of the liquid ejecting head 26 are coupled to each other. The ink supplied from the liquid container 14 to the flow channel member 25 is discharged from the discharge flow channel Q1 and is supplied to the liquid ejecting head 26 via the supply flow channel Q2.

The coupling member 27 is a mounting component for electrically coupling the liquid ejecting head 26 and the control unit 20. As illustrated in FIGS. 3 and 4, the coupling member 27 includes an electric wiring member 271, a housing portion 273, and a first coupling portion C1. The electric wiring member 271 is a wiring substrate on which an electric wiring for supplying, to the liquid ejecting head 26, various signals for ejecting the ink from the nozzle is formed. The first coupling portion C1 is a convex connector for electrically coupling the electric wiring member 271 and the liquid ejecting head 26, and is installed on a surface of the electric wiring member 271 on the liquid ejecting head 26 side. For example, the first coupling portion C1 is formed in a long shape along the X axis. The housing portion 273 is a hollow structure for storing the electric wiring member 271, and includes a bottom surface portion 70 constituting the bottom surface of an internal space S. The electric wiring member 271 is installed on the upper surface of the bottom surface portion 70. By inserting the first coupling portion C1 into an opening Oa formed in the bottom surface portion 70, a tip of the first coupling portion C1 is exposed to the outside of the housing portion 273 from the opening Oa. The lower surface of the bottom surface portion 70 is in contact with the second surface F2 of the liquid ejecting head 26.

A second coupling portion C2 that can be coupled to the first coupling portion C1 is formed on the second surface F2 of the liquid ejecting head 26. The second coupling portion C2 is a concave connector for electrically coupling the electric wiring member 271 and the liquid ejecting head 26. The second coupling portion C2 is formed at a position corresponding to the opening Oa of the housing portion 273. For example, the second coupling portion C2 is formed in a long shape along the X axis. By fitting the first coupling portion C1 and the second coupling portion C2 in each other, terminals of the first coupling portion C1 and the second coupling portion C2 are electrically coupled to each other.

As illustrated in FIGS. 2 and 3, the carriage 242 includes a holding portion 41 and a wall portion 43. The holding portion 41 is a flat member for holding the liquid ejecting head 26. The wall portion 43 is a frame-like member that protrudes from the peripheral edge of the holding portion 41 to a negative side of the Z axis. The liquid ejecting head 26 is held on the surface of the holding portion 41 on the negative side of the Z axis. The holding portion 41 and the coupling member 27 are located on opposite sides with the liquid ejecting head 26 interposed therebetween. An opening Ob is formed in the holding portion 41 such that a nozzle N of the liquid ejecting head 26 is exposed therethrough. The liquid ejecting head 26 and the coupling member 27 are fixed to the holding portion 41.

Hereinafter, a structure for fixing the liquid ejecting head 26 and the coupling member 27 to the holding portion 41 will be described. As illustrated in FIG. 4, a first through-hole Ha1 and a second through-hole Ha2 that penetrate the housing portion 273 along the Z axis are provided in the housing portion 273 of each coupling member 27. In the first embodiment, the first through-hole Ha1 and the second through-hole Ha2 are formed on opposite sides with the internal space S of the housing portion 273 interposed therebetween. For example, when viewed from the internal space S, the first through-hole Ha1 is formed on a negative side of the X axis, and the second through-hole Ha2 is formed on a positive side of the X axis. The first coupling portion C1 is installed between the first through-hole Ha1 and the second through-hole Ha2. In the first embodiment, the first through-hole Ha1, the second through-hole Ha2, and the first coupling portion C1 are arranged in parallel to each other along the X axis. In the following description, when it is not necessary to particularly distinguish the first through-hole Ha1 and the second through-hole Ha2 from each other, the first through-hole Ha1 and the second through-hole Ha2 are simply referred to as a "through-hole Ha".

The liquid ejecting head 26 is provided with a first attachment hole Hb1 and a second attachment hole Hb2 that penetrate the liquid ejecting head 26 along the Z axis. In detail, the first attachment hole Hb1 is formed at a position corresponding to the first through-hole Ha1, and the second attachment hole Hb2 is formed at a position corresponding to the second through-hole Ha2. The first attachment hole Hb1 and the second attachment hole Hb2 are located on opposite sides with the second coupling portion C2 interposed therebetween. That is, the second coupling portion C2 is located between the first attachment hole Hb1 and the second attachment hole Hb2. In the first embodiment, the first attachment hole Hb1, the second attachment hole Hb2, and the second coupling portion C2 are arranged in parallel to each other along the X axis. In the following description, when it is not necessary to particularly distinguish the first attachment hole Hb1 and the second attachment hole Hb2 from each other, the first attachment hole Hb1 and the second attachment hole Hb2 are simply referred to as an "attachment hole Hb".

The holding portion 41 is provided with a first hole portion Hc1 and a second hole portion Hc2 that are bottomed holes. In detail, the first hold portion Hc1 is formed at a position corresponding to the first through-hole Ha1 and the first attachment hole Hb1, and the second hole portion Hc2 is formed at a position corresponding to the second through-hole Ha2 and the second attachment hole Hb2. In the following description, when it is not necessary to particularly distinguish the first hole portion Hc1 and the second hole portion Hc2 from each other, the first hole portion Hc1 and the second hole portion Hc2 are simply referred to as a "hole portion Hc". The through-hole Ha, the attachment hole Hb, and the hole portion Hc are formed to overlap each other in a plan view from the Z axis direction. In other words, the through-hole Ha, the attachment hole Hb, and the hole portion Hc are formed at the same position in both the X axis direction and the Y axis direction. The cross-sections of the through-hole Ha, the attachment hole Hb, and the hole portion Hc when viewed from the Z axis direction is circular.

The liquid ejecting head 26 and the coupling member 27 are fixed to the holding portion 41 by a first fixing member E1 and a second fixing member E2. The first fixing member E1 is inserted into the first through-hole Ha1, the first attachment hole Hb1, and the first hole portion Hc1. The second fixing member E2 is inserted into the second through-hole Ha2, the second attachment hole Hb2, and the second hole portion Hc2. In the following description, when it is not necessary to particularly distinguish the first fixing member E1 and the second fixing member E2 from each other, the first fixing member E1 and the second fixing member E2 are simply referred to as a "fixing member E". As understood from the above description, in the first embodiment, the liquid ejecting head 26 and the coupling member 27 are fixed to the holding portion 41 by the two fixing members E located on opposite sides with the first coupling portion C1 and the second coupling portion C2 interposed therebetween.

As illustrated in FIG. 4, the fixing member E is a cylindrical member extending along the Z axis. The fixing member E according to the first embodiment is divided into a first portion P1 and a second portion P2 along the Z axis. The first portion P1 is a portion of the fixing member E, which is located on a positive side of the Z axis. The second portion P2 is a portion of the fixing member E, which is located on the negative side of the Z axis.

The first portion P1 is located inside the hole portion Hc and inside the attachment hole Hb in the fixing member E. A screw is formed at a portion of the first portion P1, which is located inside the hole portion Hc. Therefore, the fixing member E is fixed to the holding portion 41 by inserting the tip of the first portion P1 into the hole portion Hc. In the first embodiment, the outer diameter of the first portion P1 and the inner diameter of the attachment hole Hb are substantially equal to each other, and the outer peripheral surface of the first portion P1 and the inner peripheral surface of the attachment hole Hb abut on each other. That is, no gap is formed between the outer peripheral surface of the first portion P1 and the inner peripheral surface of the attachment hole Hb. In the first embodiment, the liquid ejecting head 26 is supported on the holding portion 41 by fixing the fixing member E to the hole portion Hc of the holding portion 41 in a state in which the fixing member E passes through the attachment hole Hb.

In the second portion P2, a gap is formed between the outer peripheral surface of the fixing member E located inside the through-hole Ha of the fixing member E and the inner peripheral surface of the through-hole Ha. That is, the inner diameter DHa of the through-hole Ha is larger than the outer diameter D2 of the second portion P2. For example, the inner diameter DHa of the through-hole Ha is larger than the outer diameter D2 of the second portion P2 and is smaller than two times the outer diameter D2. In other words, the cross-sectional area of a top portion of the fixing member E is smaller than the cross-sectional area of the through-hole Ha. In the first embodiment, the outer diameter D1 of the first portion P1 is smaller than the outer diameter D2 of the second portion P2. As understood from the above description, in the first embodiment, as the fixing member E for fixing the liquid ejecting head 26 to the holding portion 41 passes through the through-hole Ha, the coupling member 27 is supported on the holding portion 41. The liquid ejecting head 26, the carriage 242, the coupling member 27, and the fixing member E correspond to a liquid ejecting unit.

Figure 5:
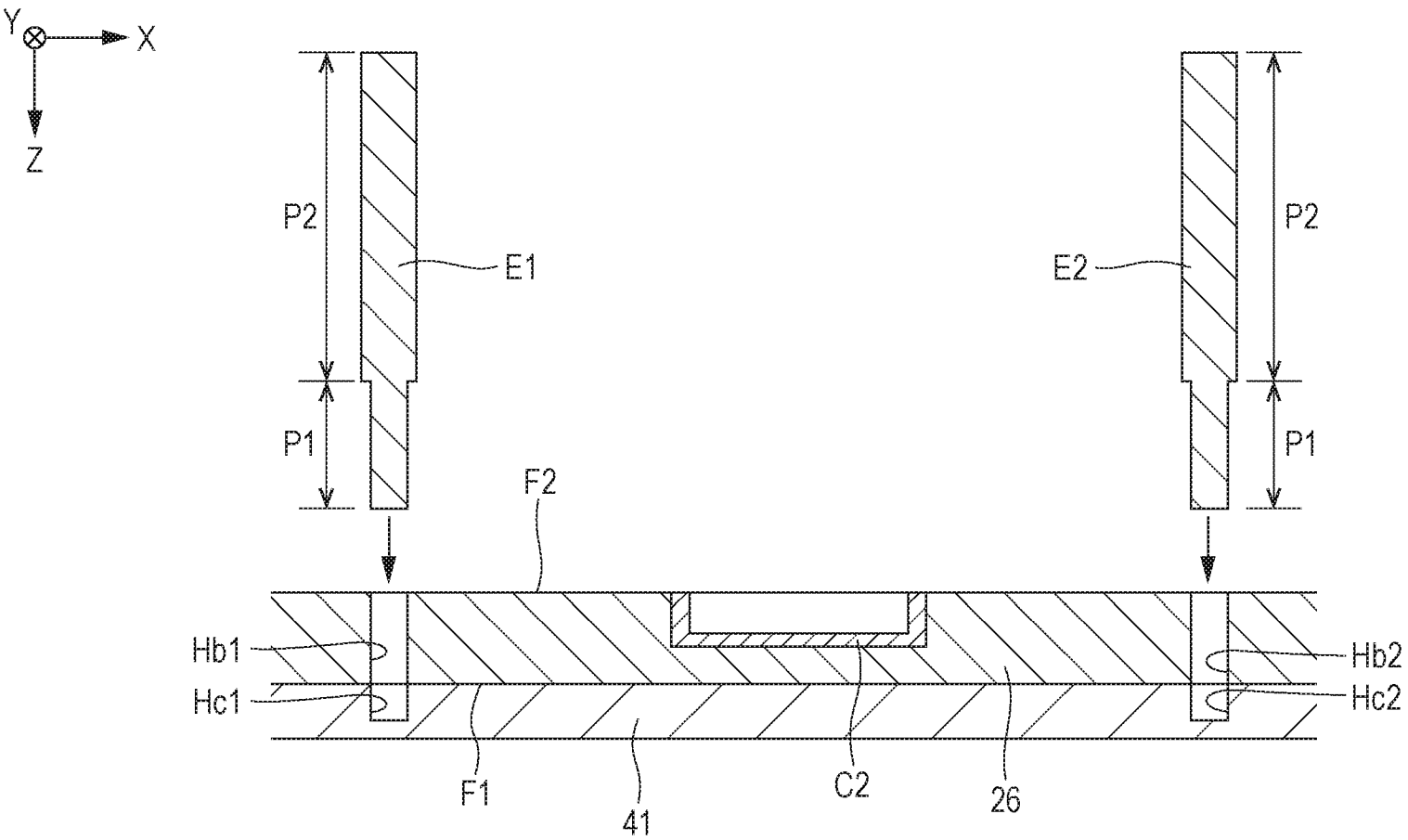
FIG. 5 is a diagram of a process of inserting a fixing member into an attachment hole and a hole portion.
Figure 6:
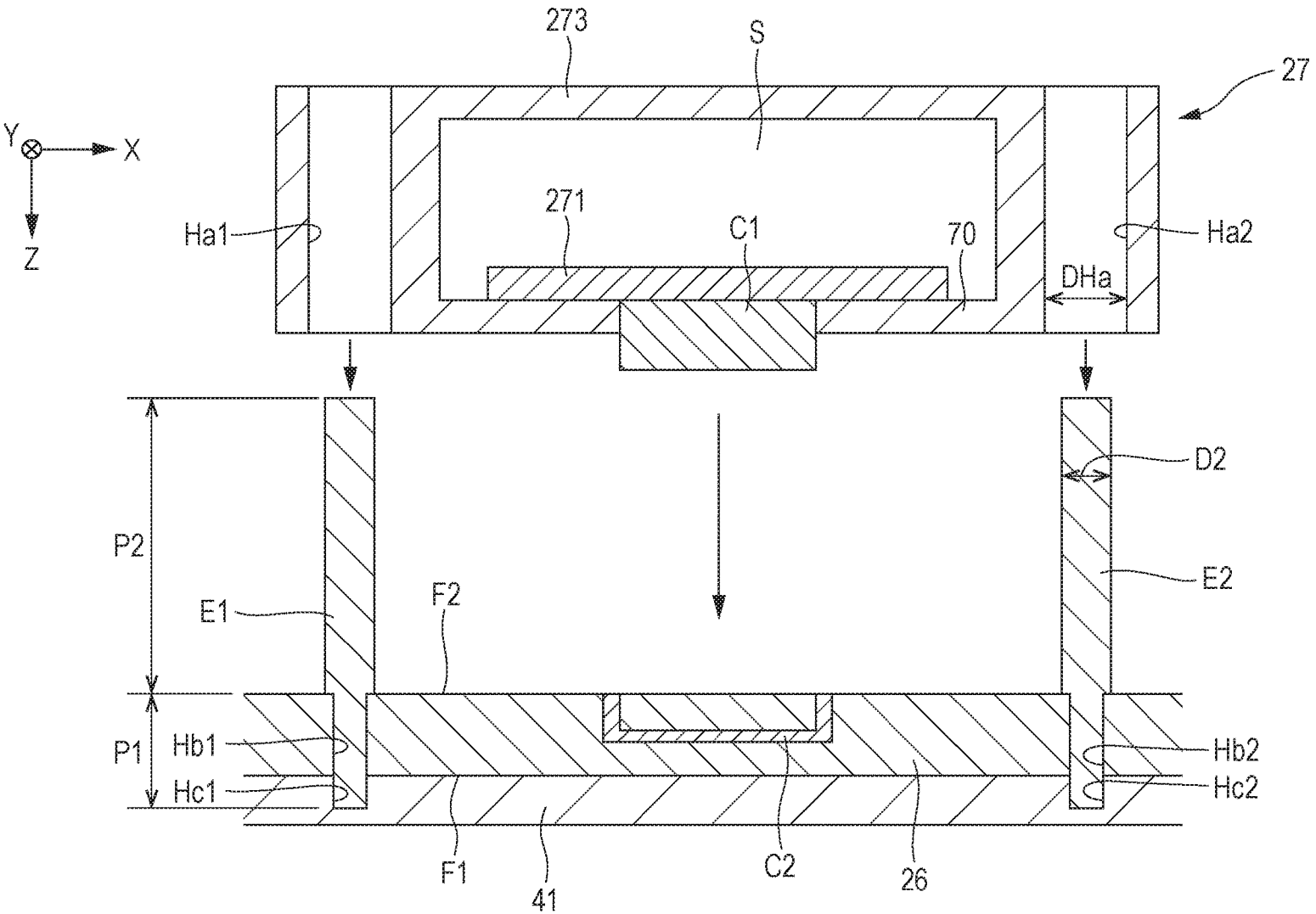
FIG. 6 is a diagram of a process of inserting the fixing member into a through-hole.
Figure 7:
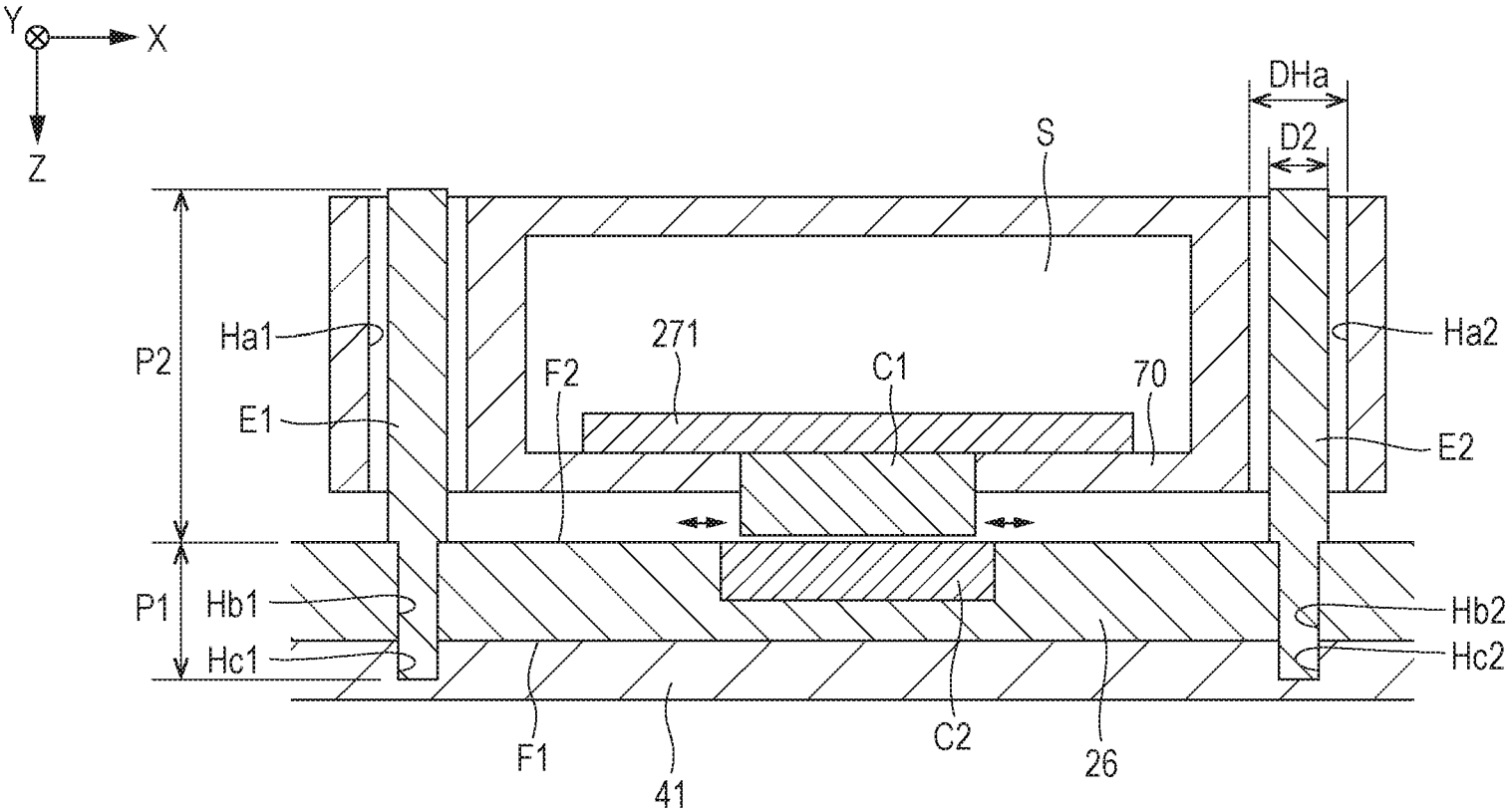
FIG. 7 is a diagram of a process of coupling a first coupling portion and a second coupling portion.

Hereinafter, a process of manufacturing the liquid ejecting unit will be described. FIGS. 5 to 7 are diagrams illustrating the process of manufacturing the liquid ejecting unit. In a process U1, as illustrated in FIG. 5, the liquid ejecting head 26 is fixed to the holding portion 41 by the fixing member E. In detail, in a state in which the liquid ejecting head 26 is mounted on the upper surface of the holding portion 41 such that the attachment hole Hb of the liquid ejecting head 26 corresponds to the hole portion Hc of the holding portion 41, the first portion P1 of the fixing member E is inserted into the hole portion Hc and the attachment hole Hb. In a state in which the first portion P1 is inserted into the attachment hole Hb, the tip of the first portion P1 is turned into the hole portion Hc until the lower surface of the second portion P2 abuts on the second surface F2, so that the liquid ejecting head 26 is fixed to the holding portion 41.

In a process U2 after the process U1, as illustrated in FIG. 6, the coupling member 27 is installed such that the second portion P2 of the fixing member E is inserted into the through-hole Ha of the coupling member 27. In a process of U3 after the process U2, as illustrated in FIG. 7, the coupling member 27 is coupled to the liquid ejecting head 26. In detail, in a state in which the second portion P2 is inserted into the through-hole Ha, the first coupling portion C1 and the second coupling portion C2 are coupled to each other. As described above, a gap is formed between the outer peripheral surface of the fixing member E and the inner peripheral surface of the through-hole Ha of the coupling member 27. Therefore, before the coupling between the first coupling portion C1 and the second coupling portion C2, in a state in which the second portion P2 is inserted into the through-hole Ha, a relative positional relationship between the first coupling portion C1 and the second coupling portion C2 can be adjusted by the gap in the X-Y plane. That is, after the positional relationship between the first coupling portion C1 and the second coupling portion C2 is adjusted, the first coupling portion C1 and the second coupling portion C2 can be coupled to each other. As understood from the above description, the fixing member E passes through the through-hole Ha in a state in which the first coupling portion C1 and the second coupling portion C2 are coupled to each other. The liquid ejecting unit of FIG. 4 is manufactured through the processes U1 to U3. The process of manufacturing the liquid ejecting unit is not limited to the above illustration. For example, in a state in which the fixing member E is not completely fixed to the hole portion Hc and the fixing is temporarily stopped in the process U1, after the process U2 and the process U3 are executed to couple the first coupling portion C1 and the second coupling portion C2 to each other, the fixing member E may be fixed to the hole portion Hc.

In a configuration in which the coupling member 27 and the liquid ejecting head 26 are individually fixed to the holding portion 41 (hereinafter, referred to as a "comparative example"), the process of manufacturing the liquid ejecting unit is complicated. In detail, a fixing member that fixes the coupling member 27 to the holding portion 41 and a fixing member that fixes the liquid ejecting head 26 to the holding portion 41 are separately required. On the other hand, according to the configuration of the first embodiment, the fixing member E that fixes the liquid ejecting head 26 to the holding portion 41 passes through the through-hole Ha of the coupling member 27, so that the coupling member 27 can be supported on the holding portion 41. Therefore, the process of manufacturing the liquid ejecting unit is simplified as compared to the comparative example. Further, in the comparative example, a member that fixes the coupling member 27 and the holding portion 41 and a member that fixes the liquid ejecting head 26 and the holding portion 41 are required, and manufacturing costs of the liquid ejecting unit increase. In the first embodiment, since the fixing member E that fixes the liquid ejecting head 26 to the holding portion 41 is used for supporting the coupling member 27, manufacturing costs of the liquid ejecting apparatus 100 are reduced as compared to the comparative example.

In the first embodiment, since the attachment hole Hb through which the fixing member E passes is provided in the liquid ejecting head 26, the fixing member E passes through the attachment hole Hb, so that the liquid ejecting head 26 can be easily supported on the holding portion 41.

In a configuration in which no gap is formed between the outer peripheral surface of the fixing member E and the inner peripheral surface of the through-hole Ha of the coupling member 27 (hereinafter, referred to as an "aspect A"), as the fixing member E is inserted into the through-hole Ha, the positional relationship between the first coupling portion C1 and the second coupling portion C2 is determined. Therefore, when a manufacturing error occurs in the position and the size of the through-hole Ha, the size of the fixing member E, or the like, there is a possibility that an error occurs in the positional relationship between the first coupling portion C1 and the second coupling portion C2. Further, when the first coupling portion C1 and the second coupling portion C2 are coupled to each other in a state in which an error occurs in the positional relationship, there is a possibility that a stress may be applied between the first coupling portion C1 and the second coupling portion C2. On the other hand, according to the configuration of the first embodiment in which a gap is formed between the outer peripheral surface of the fixing member E and the inner peripheral surface of the through-hole Ha of the coupling member 27, even in a state in which the fixing member E is inserted into the through-hole Ha, the relative positional relationship between the first coupling portion C1 and the second coupling portion C2 is not completely determined. Therefore, the relative positional relationship between the first coupling portion C1 and the second coupling portion C2 can be adjusted by the gap. That is, the fixing member E can be used as a rough guide. Therefore, as compared to the aspect A, it is possible to reduce the error in the positional relationship between the first coupling portion C1 and the second coupling portion C2 and the stress applied between the first coupling portion C1 and the second coupling portion C2. As will be described below with reference to FIG. 12, the aspect A is also included in the scope of the present disclosure.

Further, in the first embodiment, since the cross-sectional area of the top portion of the fixing member E is smaller than the cross-sectional area of the through-hole Ha, there is an advantage in that the coupling member 27 can be easily removed from the holding portion 41.

B. Second Embodiment

A second embodiment will be described below. In the following examples, an element having the same function as that of the first embodiment is designated by the same reference numeral used in the description of the first embodiment, and detailed description thereof will be omitted as appropriate.

Figure 8:
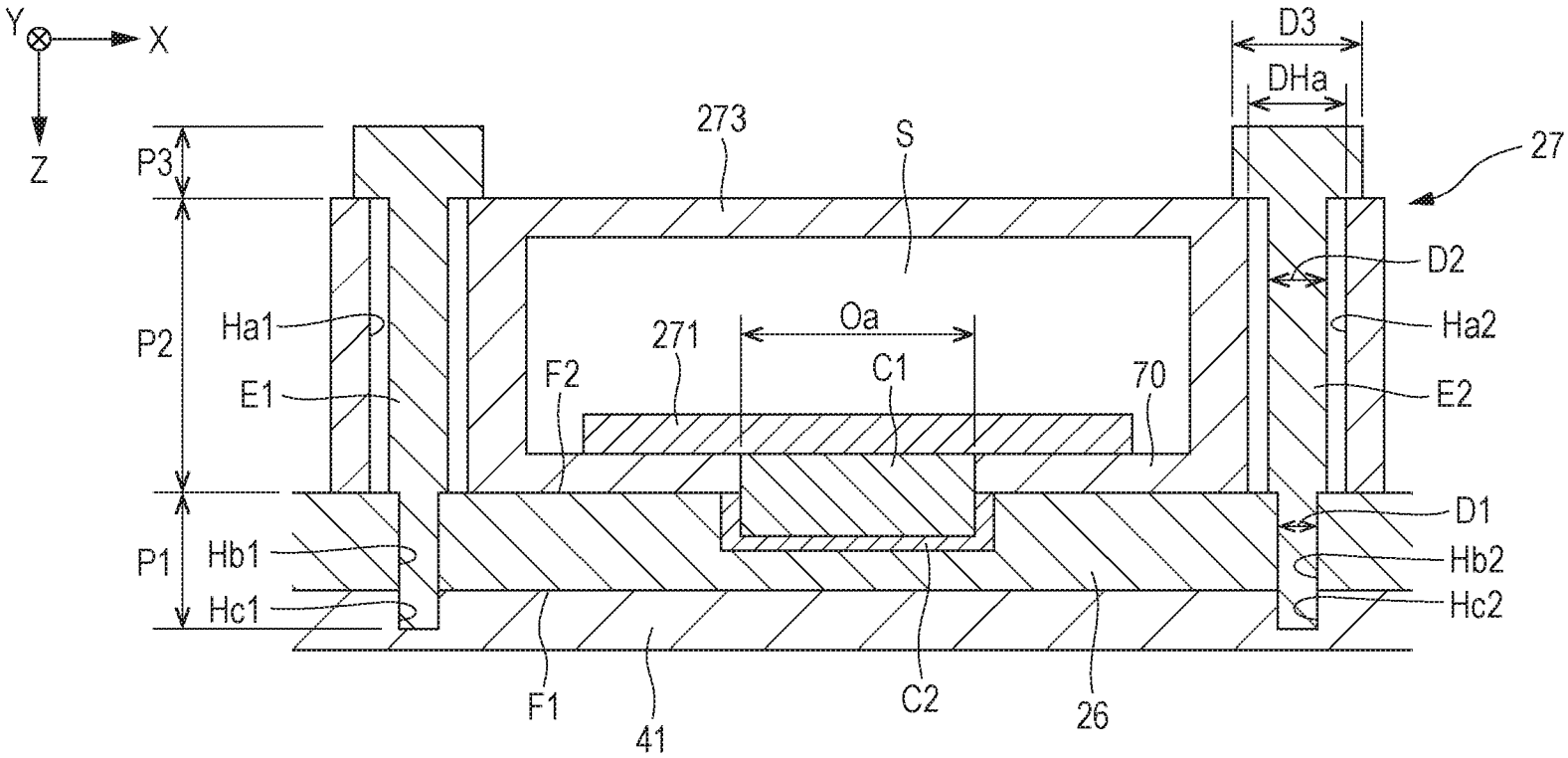
FIG. 8 is a sectional view of a liquid ejecting unit according to a second embodiment.

FIG. 8 is a sectional view of a liquid ejecting unit according to a second embodiment. The shape of the fixing member E according to the second embodiment is different from the shape of the fixing member E according to the first embodiment. The configurations other than the fixing member E in the liquid ejecting unit are the same as those according to the first embodiment. As illustrated in FIG. 8, the fixing member E according to the second embodiment is divided into the first portion P1 and the second portion P2, which are the same as those according to the first embodiment, and a third portion P3. Similar to the first embodiment, the first portion P1 is located inside the hole portion Hc and inside the attachment hole Hb in the fixing member E. Similar to the first embodiment, the second portion P2 is located inside the through-hole Ha in the fixing member E. Similar to the first embodiment, a gap is formed between the outer peripheral surface of the fixing member E and the inner peripheral surface of the through-hole Ha of the coupling member 27.

The third portion P3 is an end portion of the fixing member E on the negative side of the Z axis, and is portion exposed to the outside of the housing portion 273 from the through-hole Ha. The outer diameter D3 of the third portion P3 is larger than the inner diameter DHa of the through-hole Ha. That is, the cross-sectional area of the top portion of the fixing member E is larger than the cross-sectional area of the through-hole Ha. The lower surface of the third portion P3 abuts on the surface of the housing portion 273, so that the coupling member 27 is fixed to the holding portion 41.

Figure 9:
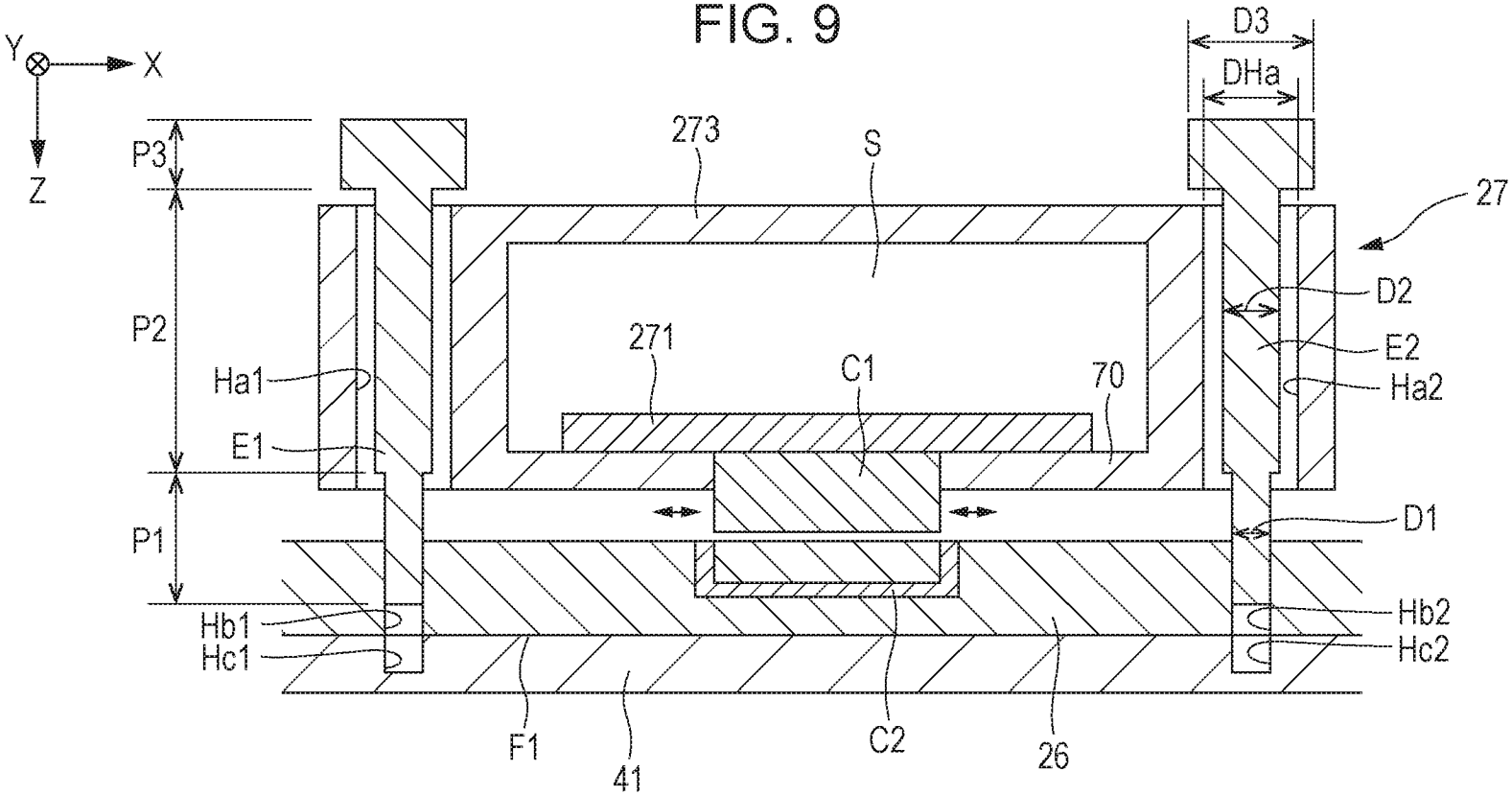
FIG. 9 is a diagram of a process of coupling a first coupling portion and a second coupling portion.

FIG. 9 is a diagram for illustrating a process of coupling the first coupling portion C1 and the second coupling portion C2. As illustrated in FIG. 9, after the fixing member E is inserted into the through-hole Ha, in a state in which the fixing member E is not completely fixed to the attachment hole Hb and the hole portion Hc and the fixing is temporarily stopped, the first coupling portion C1 and the second coupling portion C2 are coupled to each other. As described above, a gap is formed between the outer peripheral surface of the fixing member E and the inner peripheral surface of the through-hole Ha of the coupling member 27. Therefore, before the coupling between the first coupling portion C1 and the second coupling portion C2, in a state in which the second portion P2 is inserted into the through-hole Ha, the relative positional relationship between the first coupling portion C1 and the second coupling portion C2 can be adjusted by the gap in the X-Y plane. That is, similar to the first embodiment, after the positional relationship between the first coupling portion C1 and the second coupling portion C2 is adjusted, the first coupling portion C1 and the second coupling portion C2 can be coupled to each other. After the first coupling portion C1 and the second coupling portion C2 are coupled to each other, the fixing member E is completely fixed to the attachment hole Hb and the hole portion Hc, so that the liquid ejecting unit of FIG. 8 is manufactured.

In the second embodiment, the same effect as that of the first embodiment is realized. According to the configuration of the second embodiment in which the cross-sectional area of the third portion P3 that is the top portion of the fixing member E is larger than the cross-sectional area of the through-hole Ha, since the movement of the coupling member 27 is restricted by the third portion P3, it is difficult to remove the coupling member 27 from the fixing member E. Therefore, there is an advantage in that it is difficult to release the coupling between the first coupling portion C1 and the second coupling portion C2.

C. Third Embodiment

In the liquid ejecting unit of the first embodiment, in the process U2 of FIG. 6, in a state in which the first fixing member E1 is inserted into the first through-hole Ha1 and the second fixing member E2 is inserted into the second through-hole Ha2 (hereinafter, referred to as a "first state"), the first coupling portion C1 and the second coupling portion C2 are appropriately coupled to each other. However, in the process U2, a direction of the coupling member 27 with respect to the liquid ejecting head 26 may be wrong. In detail, a state in which the coupling member 27 is rotated with respect to the liquid ejecting head 26 such that the first fixing member E1 is inserted into the second through-hole Ha2 and the second fixing member E2 is inserted into the first through-hole Ha1 (hereinafter, referred to as a "second state") is also assumed. Even in the above-described second state, in the configuration in which the first coupling portion C1 and the second coupling portion C2 are fitted in each other, the terminals of the first coupling portion C1 and the second coupling portion C2 may not be appropriately coupled to each other. In the third embodiment, a configuration in which the coupling between the first coupling portion C1 and the second coupling portion C2 is prevented in the second state in which the direction of the coupling member 27 is wrong as described above is illustrated.

Figure 10:
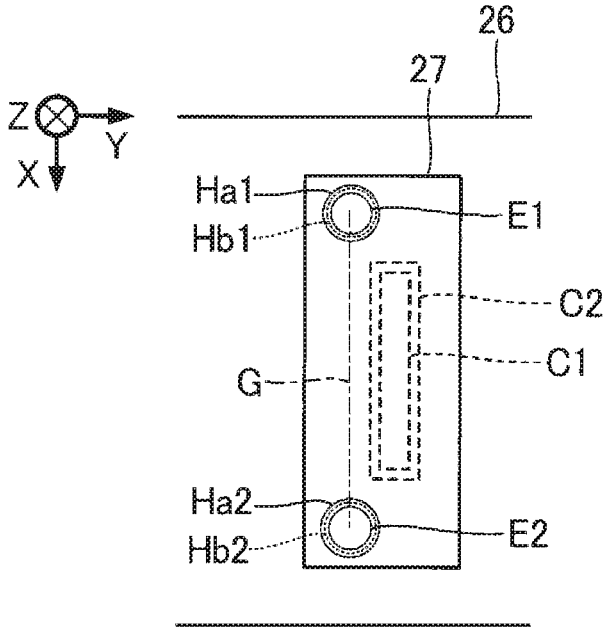
FIG. 10 is a plan view of a liquid ejecting unit in a first state according to a third embodiment.

The position of the first coupling portion C1 of the coupling member 27 according to the third embodiment is different from that according to the first embodiment. The other configurations of the liquid ejecting unit are the same as those according to the first embodiment. FIG. 10 is a plan view on which the coupling member 27 and the liquid ejecting head 26 are focused in the first state. In the third embodiment, as illustrated in FIG. 10, in a plan view from the Z axis direction, the first coupling portion C1 is installed so as not to overlap a line segment G connecting the center of the first through-hole Ha1 and the center of the second through-hole Ha2. In other words, the first coupling portion C1 may be asymmetric with respect to the line segment G. In the first state illustrated in FIG. 10, the first coupling portion C1 and the second coupling portion C2 overlap each other in a plan view. Therefore, the first coupling portion C1 and the second coupling portion C2 are appropriately coupled to each other.

Figure 11:
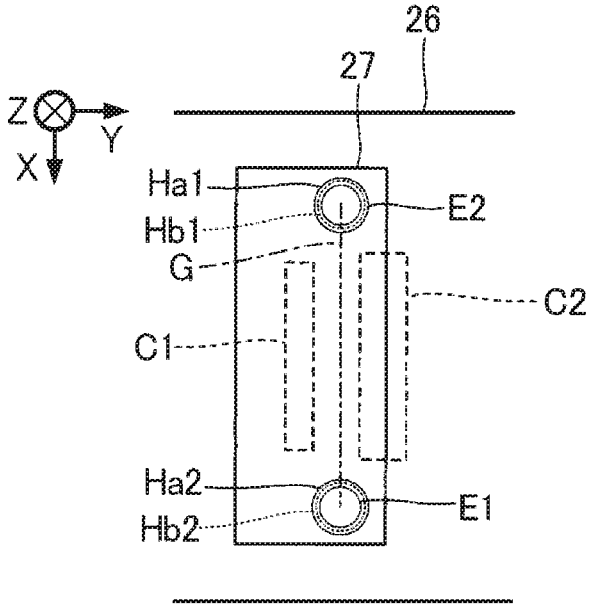
FIG. 11 is a plan view of the liquid ejecting unit in a second state.

FIG. 11 is a plan view on which the coupling member 27 and the liquid ejecting head 26 are focused in the second state. In detail, in the second state of FIG. 11, the coupling member 27 is rotated from the first state illustrated in FIG. 10 by 180 degrees in the X-Y plane (hereinafter, referred to as "mirror reversal). As illustrated in FIG. 11, in the second state, the positions of the first coupling portion C1 and the second coupling portion C2 are different from each other in a plan view. That is, since the first coupling portion C1 and the second coupling portion C2 do not overlap each other, the first coupling portion C1 and the second coupling portion C2 are not fitted in each other.

In the third embodiment, the same effect as that of the first embodiment is realized. In the third embodiment, in particular, in the second state, since the positions of the first coupling portion C1 and the second coupling portion C2 are different from each other, a possibility that the first coupling portion C1 and the second coupling portion C2 are not appropriately coupled to each other when the direction of the coupling member 27 with respect to the liquid ejecting head 26 is wrong can be reduced in the process U2 in which the fixing member E is inserted into the through-hole Ha.

In the third embodiment, as the position of the first coupling portion C1 is different from that according to the first embodiment, the first coupling portion C1 and the second coupling portion C2 are prevented from being fitted in each other in the second state. However, a configuration for preventing the first coupling portion C1 and the second coupling portion C2 from being fitted in each other in the second state is not limited to the above-described examples. For example, a configuration is also employed in which one of the first through-hole Ha1 and the second through-hole Ha2 is closer to the first coupling portion C1 than the other one thereof. That is, the first coupling portion C1 is disposed at a position that is not line-symmetric with respect to a perpendicular line passing through the midpoint of the line segment G. Further, the position of the second coupling portion C2 may be different from that according to the first embodiment. In detail, in a plan view from the Z axis direction, the second coupling portion C2 is installed so as not to overlap a straight line connecting the center of the first attachment hole Hb1 and the center of the second attachment hole Hb2. As understood from the above description, detailed configurations of the liquid ejecting head 26 and the coupling member 27 are predetermined as long as the first coupling portion C1 and the second coupling portion C2 are not fitted in each other in the second state. The configuration of the third embodiment may be applied to the second embodiment.

Further, in the third embodiment, a configuration in which miscoupling between the first coupling portion C1 and the second coupling portion C2 is prevented when the liquid ejecting unit is provided with two fixing members E and two through-holes Ha is illustrated. However, for example, a configuration for preventing the miscoupling between the first coupling portion C1 and the second coupling portion C2 is employed even when the liquid ejecting unit is provided with one fixing member E. In detail, when the fixing member E is inserted into the through-hole Ha of the coupling member 27 in the first state, the first coupling portion C1 and the second coupling portion C2 can be coupled to each other. In the second state in which the coupling member 27 is mirror-reversed from the first state, the first coupling portion C1 and the second coupling portion C2 cannot be coupled to each other. That is, the first state is in a case where the coupling member 27 is in an appropriate direction with respect to the liquid ejecting head 26, and the second state is in a case where the coupling member 27 is not in an appropriate direction with respect to the liquid ejecting head 26.

D. Modification Example

Each embodiment illustrated above can be variously modified. Detailed modifications that can be applied to the above-described embodiments will be described as an example below. Two or more aspects selected from the following examples in a predetermined manner can be appropriately combined as long as the aspects do not contradict each other.

(1) In the above-described embodiments, the liquid ejecting head 26 and the coupling member 27 are fixed to the holding portion 41 using the two fixing members E. However, the number of the fixing members E for fixing the liquid ejecting head 26 and the coupling member 27 to the holding portion 41 is predetermined.

(2) In the above-described embodiments, the end portion on the negative side and the end portion on the positive side of the X axis in the coupling member 27 are fixed to the holding portion 41 by the fixing member. However, the position where the coupling member 27 is fixed to the holding portion 41 is not limited to the above examples. For example, a portion of the coupling member 27 on one of the positive side and the negative side in the X axis direction in a plan view may be fixed to the holding portion 41 by the two fixing members E. The positions of the through-hole Ha, the attachment hole Hb, and the hole portion Hc are also appropriately changed depending on the position where the coupling member 27 is fixed to the holding portion 41 by the fixing members E.

(3) In the above-described embodiments, the configuration is illustrated in which the first coupling portion C1 is a convex connector and the second coupling portion C2 is a concave connector. However, the first coupling portion C1 may be a concave connector and the second coupling portion C2 may be a convex connector. Further, in the above-described embodiments, the first coupling portion C1 and the second coupling portion C2 that are long are illustrated. However, the shapes of the first coupling portion C1 and the second coupling portion C2 are predetermined.

Figure 12:
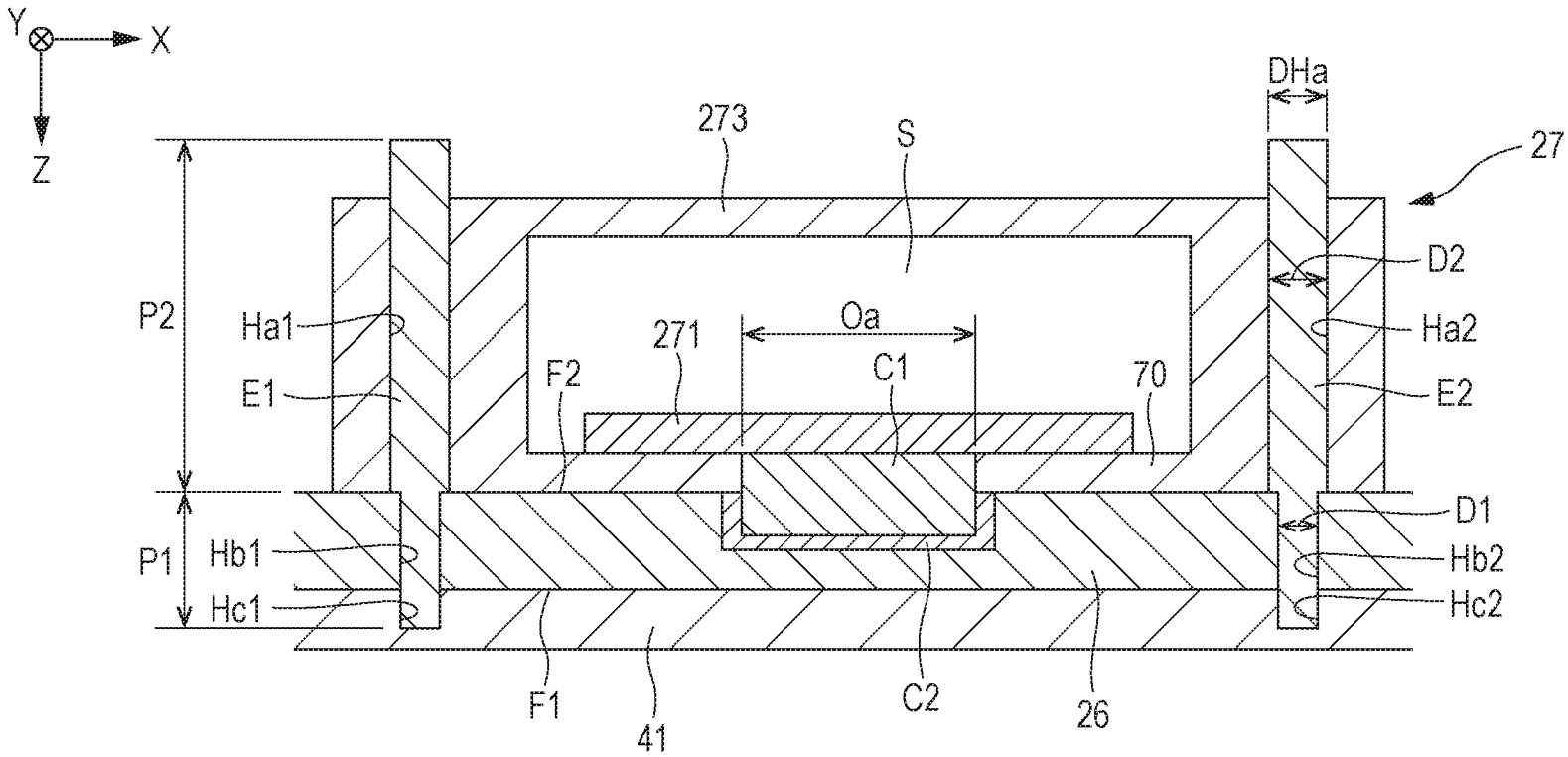
FIG. 12 is a sectional view of a liquid ejecting unit according to a modification example.

(4) In the above-described embodiments, the configuration is illustrated in which the gap is formed between the outer peripheral surface of the second portion P2 and the inner peripheral surface of the through-hole Ha. However, as illustrated in FIG. 12, the outer peripheral surface of the second portion P2 and the inner peripheral surface of the through-hole Ha may abut on each other. In the configuration of FIG. 12, the inner diameter DHa of the through-hole Ha and the outer diameter D2 of the second portion P2 are substantially equal to each other. As understood from the above description, it is not necessary that the gap is formed between the outer peripheral surface of the second portion P2 and the inner peripheral surface of the through-hole Ha.

(5) In the above-described embodiments, the shape of the fixing member E is predetermined. For example, the fixing member E may include a portion that is different from the first portion P1, the second portion P2, and the third portion P3, and the cylindrical fixing member E having a constant inner diameter over the entire length may be used. Further, in the above-described embodiments, the configuration is illustrated in which the cross-sectional shape of the fixing member E is circular. However, the cross-sectional shape of the fixing member E is predetermined. The shapes of the through-hole Ha, the attachment hole Hb, and the hole portion Hc are also appropriately changed depending on the shape of the fixing member E.

(6) In the above-described embodiments, the fixing member E may be formed integrally with the holding portion 41. For example, the fixing member E that protrudes from the surface of the holding portion 41 on the liquid ejecting head 26 side toward the negative side of the Z axis is assumed. By inserting the fixing member E protruding from the surface of the holding portion 41 into the through-hole Ha and the attachment hole Hb, the coupling member 27 and the liquid ejecting head 26 are fixed to the holding portion 41.

(7) In the above-described embodiments, the coupling member 27 having the electric wiring member 271 and the housing portion 273 is illustrated. However, the configuration of the coupling member 27 is not limited to the above examples. For example, a configuration in which the coupling member 27 includes a member that is different from the electric wiring member 271 and the housing portion 273 or a configuration in which the coupling member 27 has only the electric wiring member 271 without the housing portion 273 is also employed. Further, the coupling member 27 may include a flow channel member having a flow channel through which the ink flows, instead of the electric wiring member 271. The through-hole Ha may be formed in any of the elements included in the coupling member 27.

(8) In the above-described embodiments, a serial type liquid ejecting apparatus 100 is illustrated which causes the carriage 242, on which the liquid ejecting head 26 is mounted, to reciprocate. However, the present disclosure can be applied to a line-type liquid ejecting apparatus in which the plurality of nozzles N are distributed over the entire width of the medium 12.

(9) The liquid ejecting apparatus 100 illustrated in the above-described embodiments may be adopted for various apparatuses such as a facsimile apparatus and a copying machine in addition to equipment dedicated to printing. However, usage of the liquid ejecting apparatus of the present disclosure is not limited to printing. For example, the liquid ejecting apparatus that ejects a solution of a color material is used as a manufacturing apparatus that forms a color filter of a liquid crystal display device. Further, a liquid ejecting apparatus that ejects a solution of a conductive material is used as a manufacturing apparatus that forms a wiring and an electrode of a wiring substrate.

What is claimed is:

1. A liquid ejecting unit comprising:

a liquid ejecting head configured to eject a liquid;

a holding portion holding the liquid ejecting head;

a coupling member; and a first fixing member fixing the liquid ejecting head to the holding portion, wherein the coupling member is provided with a first coupling portion and a first through-hole, the liquid ejecting head is provided with a second coupling portion that is configured to be coupled to the first coupling portion, the first fixing member passes through the first through-hole in a state in which the first coupling portion and the second coupling portion are coupled to each other, and a gap is formed between an outer peripheral surface of the first fixing member and an inner peripheral surface of the first through-hole.

2. The liquid ejecting unit according to claim 1, wherein the liquid ejecting head is provided with a first attachment hole through which the first fixing member passes.

3. The liquid ejecting unit according to claim 1, wherein a cross-sectional area of a top portion of the first fixing member is smaller than a cross-sectional area of the first through-hole.

4. The liquid ejecting unit according to claim 1, wherein a cross-sectional area of a top portion of the first fixing member is larger than a cross-sectional area of the first through-hole.

5. The liquid ejecting unit according to claim 1, further comprising:

a second fixing member fixing the liquid ejecting head to the holding portion, wherein the coupling member is provided with a second through-hole, the liquid ejecting head is provided with a second attachment hole, and the second fixing member passes through the second through-hole and the second attachment hole.

6. The liquid ejecting unit according to claim 5, wherein the first coupling portion and the second coupling portion have different positions in a state in which the coupling member is rotated with respect to the liquid ejecting head such that the first fixing member is inserted into the second through-hole and the second fixing member is inserted into the first through-hole.

7. The liquid ejecting unit according to claim 1, wherein the first coupling portion and the second coupling portion are configured to be coupled to each other when the first fixing member is inserted into the first through-hole of the coupling member in a first state, and the first coupling portion and the second coupling portion are configured not to be coupled to each other in a second state in which the coupling member is mirror-reversed from the first state.

8. The liquid ejecting unit according to claim 1, wherein the coupling member includes an electric wiring member having an electric wiring.

9. The liquid ejecting unit according to claim 1, wherein the coupling member includes a flow channel member having a flow channel.

10. A liquid ejecting apparatus comprising:

a liquid ejecting head according to claim 1; and a controller controlling the liquid ejecting head.

11. A liquid ejecting unit comprising:

a liquid ejecting head configured to eject a liquid, the liquid ejecting head comprising a first attachment hole and a second attachment hole;

a holding portion holding the liquid ejecting head;

a coupling member; and a first fixing member and a second fixing member fixing the liquid ejecting head to the holding portion, wherein the coupling member is provided with a first coupling portion, a first through-hole, and a second through-hole, the liquid ejecting head is provided with a second coupling portion that is configured to be coupled to the first coupling portion, the first fixing member passes through the first through-hole in a state in which the first coupling portion and the second coupling portion are coupled to each other, the second fixing member passes through the second through-hole and the second attachment hole, and the first coupling portion and the second coupling portion have different positions in a state in which the coupling member is rotated with respect to the liquid ejecting head such that the first fixing member is inserted into the second through-hole and the second fixing member is inserted into the first through-hole.

12. A liquid ejecting apparatus comprising:

the liquid ejecting unit according to claim 11; and a controller controlling the liquid ejecting head.

13. A liquid ejecting unit comprising:

a liquid ejecting head configured to eject a liquid from a plurality of nozzles;

a holding portion that holds the liquid ejecting head and that includes an opening to expose the plurality of nozzles through the opening so that the liquid can be ejected from the plurality of nozzles;

a coupling member; and a first fixing member fixing the liquid ejecting head to the holding portion, wherein the coupling member is provided with a first coupling portion and a first through-hole, the liquid ejecting head is provided with a second coupling portion that is configured to be coupled to the first coupling portion by contacting each other, the first fixing member passes through the first through-hole in a state in which the first coupling portion and the second coupling portion are coupled to each other, the liquid ejecting head is provided with an attachment hole, the holding portion is provided with a hole portion that is a recessed shape, and the first fixing member passes through the first through-hole and the attachment hole and is inserted to the hole portion in a state in which the first coupling portion and the second coupling portion are coupled to each other.

14. The liquid ejecting unit according to claim 13, wherein the liquid ejecting head is configured to eject the liquid to a first direction, and the first direction is the same as a direction that the first fixing member is inserted to the first through hole and is the same as a direction that the first coupling portion is coupled to the second coupling portion.

15. The liquid ejecting unit according to claim 13, wherein a terminal end of the first fixing member extending vertically beyond the nozzles on a side of the liquid ejecting head opposite to a supply flow channel side of the liquid ejecting head.

16. The liquid ejecting unit according to claim 13, wherein the holding portion is a part of a carriage.

17. The liquid ejecting unit according to claim 13, further comprising a second liquid ejecting head configured to eject a liquid, wherein the holding portion further holds the second liquid ejecting head.

18. A liquid ejecting apparatus comprising:

the liquid ejecting unit according to claim 13; and a controller controlling the liquid ejecting head.

19. The liquid ejecting unit according to claim 13, wherein the coupling member includes an electric wiring member having an electric wiring, the electric wiring member is provided with the first coupling portion, one of the first coupling portion and the second electric coupling portion is a convex connector, the other of the first coupling portion and the second coupling portion is a concave connector, and the convex connector and the concave connector are configured to be electrically connected by fitting the first coupling portion and the second coupling portion each other.

* * * * *